US010292470B2

(12) United States Patent
Sijmons et al.

(10) Patent No.: US 10,292,470 B2
(45) Date of Patent: May 21, 2019

(54) LUGGAGE CASE HAVING SURFACE FEATURES PROVIDING ENHANCED STRENGTH

(71) Applicant: Samsonite IP Holdings S.a r.l., Luxembourg (LU)

(72) Inventors: Erik Sijmons, Oudenaarde (BE); Michael Vandemergel, Oudenaarde (BE)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 0 days.

(21) Appl. No.: 15/526,548

(22) PCT Filed: Nov. 12, 2015

(86) PCT No.: PCT/EP2015/076487
§ 371 (c)(1),
(2) Date: May 12, 2017

(87) PCT Pub. No.: WO2016/075265
PCT Pub. Date: May 19, 2016

(65) Prior Publication Data

US 2017/0318926 A1 Nov. 9, 2017

(30) Foreign Application Priority Data

Nov. 12, 2014 (EP) ..... 14192902

(51) Int. Cl.
*A45C 5/02* (2006.01)
*A45C 5/03* (2006.01)

(52) U.S. Cl.
CPC ..... *A45C 5/03* (2013.01); *A45C 5/02* (2013.01); *A45C 2005/037* (2013.01)

(58) Field of Classification Search
CPC ..... A45C 13/08; A45C 5/03; A45C 13/36; A45C 2005/037; A34C 13/36
(Continued)

(56) References Cited

U.S. PATENT DOCUMENTS 1,649,292 A 11/1927 Draper
1,987,764 A 1/1935 Walker et al.
(Continued)

FOREIGN PATENT DOCUMENTS

CN 201986882 U 9/2011
CN 202698065 U 1/2013
(Continued)

OTHER PUBLICATIONS

Extended European Search Report of corresponding European Patent Application No. 14192902.6 dated May 26, 2015, 5 pages.
(Continued)

*Primary Examiner* — Sue A Weaver
(74) *Attorney, Agent, or Firm* — Dorsey & Whitney LLP

(57) ABSTRACT

A luggage article (2) having surface features providing enhanced corner strength is provided. The luggage article may include a shell (4) at least partially formed by an outer layer (6), and including first and second shell portions (28) selectively secured together at a split line (26), the first shell portion defining a first corner region (24). The luggage article may include at least one first surface feature formed by the outer layer, the at least one first surface feature having a depth. The depth of the at least one first surface feature may be greater nearer the first corner region. The depth of the at least one first surface feature may decrease with distance away from the first corner region.

22 Claims, 6 Drawing Sheets

(58) Field of Classification Search
USPC ..... 190/37, 125, 127
See application file for complete search history.

(56) References Cited

U.S. PATENT DOCUMENTS

| | | | | | |
|---|---|---|---|---|---|
| 2,036,276 | A | | 4/1936 | Hothersall et al. | |
| 2,510,643 | A | | 6/1950 | Long | |
| 2,950,792 | A | | 8/1960 | Axtell | |
| 3,163,686 | A | | 12/1964 | Dusel et al. | |
| 3,251,460 | A | | 5/1966 | Edmonds et al. | |
| 3,313,382 | A | | 4/1967 | Rosing et al. | |
| 4,113,095 | A | | 9/1978 | Dietz et al. | |
| 4,703,519 | A | * | 10/1987 | Krenzel | A45C 3/02 112/475.08 |
| 4,712,657 | A | | 12/1987 | Myers et al. | |
| D299,589 | S | | 1/1989 | Uchiyama | |
| 4,803,769 | A | | 2/1989 | Gibbs | |
| D335,220 | S | * | 5/1993 | Ward | D3/302 |
| 5,228,546 | A | * | 7/1993 | Chang | A45C 5/02 190/103 |
| 5,685,403 | A | * | 11/1997 | Morszeck | A45C 5/02 190/126 |
| 6,035,982 | A | | 3/2000 | Wei-Chih | |
| D429,234 | S | | 8/2000 | Hargrove, III | |
| 6,131,713 | A | | 10/2000 | Sher | |
| D512,566 | S | | 12/2005 | Nuovo | |
| D627,162 | S | | 11/2010 | Weng | |
| D633,716 | S | | 3/2011 | Turella-Yuan et al. | |
| D644,435 | S | | 9/2011 | Weng | |
| D659,395 | S | | 5/2012 | Sijmons | |
| D665,998 | S | | 8/2012 | Sijmons | |
| D710,608 | S | | 8/2014 | Yoneno | |
| D710,609 | S | | 8/2014 | Sijmons | |
| 2007/0209894 | A1 | * | 9/2007 | Selvi | A45C 3/001 190/100 |
| 2011/0127264 | A1 | | 6/2011 | Whalen | |
| 2011/0186396 | A1 | | 8/2011 | Sheikh | |
| 2011/0284334 | A1 | | 11/2011 | Cheng | |

FOREIGN PATENT DOCUMENTS

| | | | |
|---|---|---|---|
| EP | 1763430 | B1 | 3/2007 |
| EP | 2429912 | B1 | 7/2014 |
| GB | 2184940 | A | 7/1987 |
| GB | 2361692 | A | 12/2003 |
| JP | 2009262499 | A | 11/2009 |
| WO | 2016/075265 | A1 | 5/2016 |

OTHER PUBLICATIONS

International Search Report and Written Opinion of International application No. PCT/EP2015/076487, dated Jan. 22, 2016, 10 pages.

* cited by examiner

LUGGAGE CASE HAVING SURFACE FEATURES PROVIDING ENHANCED STRENGTH

CROSS-REFERENCE TO RELATED APPLICATIONS

This application is the national stage application of International Patent Application No. PCT/EP2015/076487 filed on Nov. 12, 2015 and entitled "Luggage Case Having Surface Features Providing Enhanced Strength" which claims priority to European Patent Application No. 14192902.6 filed on Nov. 12, 2014 and entitled "Luggage Case Having Surface Features Providing Enhanced Strength", the entire contents of which are hereby incorporated by reference herein in their entireties.

TECHNICAL FIELD

The present invention relates to luggage articles and, in particular, to enhancements to the shell structure of luggage cases.

BACKGROUND

Luggage cases, in particular hard sided luggage cases, provide tough, protective containers for contents during travel. Given the relatively rigid structure of a hard sided luggage case, certain portions are more susceptible to large impact loads, and thus damage, when being transferred by baggage handlers and others during a journey. One such area subject to significant impact loads is the corner region. Because of its high degree of curvature, and correspondingly reduced surface area to absorb an impact, the corner region is subject to greatly magnified loads when impacted on the corner, for instance when dropped. Previous attempts to mitigate this effect have included adding additional layers to the corner to increase the structural strength of the luggage case, thickening the material cross section of the hard sided formed layer in the corner regions, and others.

As efforts continue to accelerate the use of ever lighter-weight materials in the construction of hard sided luggage, the addition of more or thicker layers at the corners to combat this problem are becoming less acceptable.

Documents that may be related to the present disclosure in that they include various approaches to the formation of surface features on luggage cases include EP2429912, EP1763430, U.S. Pat. No. 3,313,382, U.S. D665998, U.S. Pat. No. 1,649,292, U.S. D5152566, U.S. Pat. No. 4,113,095, U.S. D429234, U.S. D299589, U.S. D633716, U.S. Pat. Nos. 3,251,460, 4,712,657, 2,036,276, 2,950,792, U.S. D644435, U.S. Pat. Nos. 3,163,686, 2,510,643, U.S. D659395, U.S. D627162, U.S. D710608, U.S. D710609, U.S. Pat. No. 1,987,764, GB2184940, GB2361692, JP2009262499, U.S. Pat. Nos. 6,131,713, 6,035,982, and 4,803,769. These proposals, however, may be improved.

It is therefore desirable to provide an improved luggage article (or case), and in particular an improved luggage shell design, that can absorb and disperse an impact force applied to the luggage case to reduce the risk of damage, such as by permanent deformation.

SUMMARY

According to the present invention there is therefore provided a hardside luggage shell construction having surface features, such as grooves, extending at least partially over corner regions of the shell, the surface features having a depth deepest at the corner regions and decreasing as the surface features extend across the main face and/or sides to provide enhanced corner strength as described below and in the accompanying claims. More specifically, the surface features extend along the outer surface to form a loop from one corner region to an adjacent corner region.

The present disclosure in particular provides an improved shell structure for a luggage article that can absorb and disperse the energy of an impact such that the shell absorbs the impact force and is resistant to permanent deformation. Surface features, such as grooves, of certain width and depth dimensions are formed by the outer layer of the luggage case in certain orientations and positioned adjacent corner regions in order to maintain a small radius of the corner regions while simultaneously achieving sufficient corner strength. This corner strength is created, for example, by reinforcing the corner regions with, for example, deep grooves that may or may not fade out within the interior field, or central area, of the luggage case. The surface features provide both structure to the corner regions and flexibility to the sides of the luggage case. The depths of the surface features may depend on any one or more of the following: the dimensions (e.g., height and width) of the luggage case, the depth of the luggage case and/or luggage shell, the material thickness of the luggage shell, the number of surface features, anticipated loading of the luggage case, the distance between the surface features, and the width of the surface features themselves. The depths are or may be proportionally scaled with the depth of the luggage shell as well as with the distance between the surface features, among other factors. Where the surface features start fading out within the interior field of the luggage case may depend on the depth of the luggage shell.

In an example, a luggage article having surface features providing enhanced corner strength is provided. In some embodiments, the luggage article may include a shell at least partially formed by an outer layer, and including first and second shell portions selectively secured together at a split line, the first shell portion defining a first corner region and an adjacent second corner region. The luggage article may include at least one first surface feature formed by the outer layer, the at least one first surface feature having a length and including first, second, and third portions. In some examples, the first portion may extend at an angle relative to the second portion, and the third portion may extend at an angle relative to the second portion. In some examples, the first portion may be positioned on a peripheral wall adjacent the first corner region and may extend away from a portion of the split line. In some examples, the third portion may be positioned on the peripheral wall adjacent the second corner region and may extend away from the portion of the split line. In some examples, the second portion may extend between the first portion and the third portion.

In an example, a luggage article having surface features providing enhanced corner strength is provided. In some embodiments, the luggage article may include a shell at least partially formed by an outer layer, and including first and second shell portions selectively secured together at a split line, the first shell portion defining a first corner region. The luggage article may include at least one first surface feature formed by the outer layer, the at least one first surface feature having a depth. In some examples, the depth of the at least one first surface feature may be greater nearer the first corner region. In some examples, the depth of the at least one first surface feature decreases with distance away from the corner region, that is, as the surface feature extends away from the corner region across peripheral walls (e.g., right/left sides and/or top/bottom sides) and major faces of the luggage article, the depth of the surface feature decreases.

In some embodiments, the shell may include a major face. The at least one first surface feature may extend from a portion of the split line adjacent a corner, such as a first corner region, over a portion of the major face, and to another portion of the split line spaced away from the first corner region.

In some embodiments, the first shell portion may define a second corner region adjacent the first corner region. The at least one first surface feature may have a length and may include first, second, and third portions. The first portion may extend at an angle relative to the second portion, and the third portion may extend at an angle relative to the second portion. The first portion may be positioned on a peripheral wall adjacent the first corner region and may extend away from a portion of the split line. The third portion may be positioned on the peripheral wall adjacent the second corner region and may extend away from the portion of the split line. The second portion may extend between the first portion and the third portion.

In some embodiments, the luggage article may include at least one second surface feature formed by the outer layer, the at least one second surface feature having a length and including first, second, and third portions. In some examples, the first portion may extend at an angle relative to the second portion, and the third portion may extend at an angle relative to the second portion. In some examples, the first portion may be positioned on a peripheral wall adjacent the first corner region and may extend away from a portion of the split line. In some examples, the third portion may be positioned on the peripheral wall adjacent the second corner region and may extend away from the portion of the split line. In some examples, the second portion may extend between the first portion and the third portion.

In some embodiments, the first shell portion may define a third corner region adjacent the first corner region and diagonally opposite the second corner region. In some examples, the luggage article may include at least one second surface feature formed by the outer layer, the at least one second surface feature having a length and including first, second, and third portions. In some examples, the first portion may extend at an angle relative to the second portion, and the third portion may extend at an angle relative to the second portion. In some examples, the first portion may be positioned on a peripheral wall adjacent the first corner region and may extend away from a portion of the split line. In some examples, the third portion may be positioned on the peripheral wall adjacent the third corner region and may extend away from the portion of the split line. In some examples, the second portion may extend between the first portion and the third portion.

In some embodiments, the first surface feature may have a depth and the second surface feature may have a depth. In some examples, the depth of the surface feature positioned further from the nearer one of the corner regions may be less than the depth of the surface feature positioned closer to the nearer one of the corner regions.

In some embodiments, the first surface feature may have a depth, and the depth of the first surface feature may include a first depth at least partially within the first portion, a second depth at least partially within the second portion, and a third depth at least partially within the third portion. In some examples, the first and third depths may be greater than the second depth.

In some embodiments, a plurality of surface features may be formed by the outer layer on each side of the luggage article. Alternatively, at least one of the at least one first surface feature and/or at least one of the at least one second surface feature may be a groove. Alternatively, the first portion of the at least one first surface feature may extend along the peripheral wall or a major face. The second portion of the at least one first surface feature or the at least one second surface feature may extend along a major face.

In some embodiments, the first surface feature may have a width, and the second surface feature may have a width. In some examples, the width of the surface feature positioned further from the nearer one of the corner regions may be greater than the width of the surface feature positioned closer to the nearer one of the corner regions.

In some embodiments, the second surface feature may be spaced further away from the portion of the split line than the first surface feature.

In some embodiments, the first portion of the first surface feature may extend along a peripheral wall, and the second portion of the first surface feature may extend along a major face.

In some embodiments, the first portion of the first surface feature may extend along a major face, and the second portion of the second surface feature may extend along the major face.

In some embodiments, at least portions of the first surface feature and at least portions of the second surface feature may extend at substantially right angles relative to the split line.

In some embodiments, a portion of the first surface feature or a portion of the second surface feature may extend along but spaced away from an edge formed by the intersection of any two sides of the luggage article.

In some embodiments, the luggage article may include a third surface feature formed by the outer layer. In some examples, the third surface feature may be positioned on a side of the luggage article and may form a closed loop. In some examples, the third surface feature may be formed by the outer layer on a major face of the luggage article. In some examples, the third surface feature may be formed by the outer layer in substantially a quadrilateral shape. In some examples, the third surface feature may have a depth, and the depth of the third surface feature may be less than the depths of the first surface feature and the second surface feature. In some examples, the first surface feature, the second surface feature, and the third surface feature may define a substantially Y-shaped nominal surface adjacent the first corner region.

In some embodiments, a plurality of first surface features may have a depth. In some examples, the depth may be greater nearer the corner regions within a circular area centered at the corner region and may decrease with distance distally away from the circular area.

In some embodiments, a portion of the first surface feature or a portion of the second surface feature may extend at substantially a 45 degree angle relative to the first corner region.

In some embodiments, a portion of the first surface feature and a portion of the second surface feature may extend substantially parallel to each other.

In some embodiments, a portion of the first surface feature and a portion of the second surface feature may extend substantially parallel to each other or may extend substantially parallel to an edge formed by the intersection of a major face and an adjacent side of the luggage article.

In some embodiments, a plurality of surface features may be formed by the outer layer on each side of the luggage article.

In some embodiments, the first surface feature may extend from a first corner region to a second corner region defined on a top side of the luggage article.

In some embodiments, the first portion of the first surface feature may extend at substantially a right angle relative to the second portion of the first surface feature. In some examples, the third portion of the first surface feature may extend at substantially a right angle relative to the second portion of the first surface feature.

In some embodiments, at least one of the first surface feature or at least one of the second surface feature may be a groove.

In some embodiments, the at least one first surface feature may have a width. The depth of the at least one first surface feature may be between about 20 percent and about 67 percent, and preferably about 38 percent, of the width of the at least one first surface feature.

In some embodiments, the depth of the at least one first surface feature may be between about 0 percent and about 50 percent, preferably between about 20 percent and about 30 percent, and more preferably about 25 percent, of the width of the at least one first surface feature adjacent the first corner region.

In some embodiments, the shell may include a major face, the at least one first surface feature extending at least partially within or along the major face. The depth of the at least one first surface feature within or along the major face may be less than the depth of the at least one first surface feature adjacent the first corner region. Preferably, the depth of the at least one first surface feature within in the major face may be about 0.5 mm.

In some embodiments, the depth of the at least one first surface feature adjacent the first corner region may be between about 1 mm and about 4 mm, and preferably between about 2 mm and about 3.2 mm.

In some embodiments, the at least one first surface feature may have a width. The width of the at least one first surface feature may be between about 4 mm and about 10 mm, and preferably between about 5.5 mm and about 8.5 mm.

In some embodiments, the luggage article includes a shell at least partially formed by an outer layer, and including first and second shell portions formed at least partially by the outer layer and selectively secured together at a split line, the first shell portion defining a first corner region and an adjacent second corner region. The luggage article may include at least one first groove formed by the outer layer, the at least one first groove having a length and including first, second, and third portions.

In some embodiments, the first portion extends at an angle relative to the second portion, and the third portion extends at an angle relative to the second portion.

In some embodiments, the first portion is positioned on a peripheral wall adjacent the first corner region and extends away from a portion of the split line.

In some embodiments, the third portion is positioned on the peripheral wall adjacent the second corner region and extends away from a portion of the split line.

In some embodiments, the second portion extends between the first portion and the third portion.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various embodiments of the disclosure and should not be construed as a complete recitation of the scope of the disclosure, characterized in that.

DETAILED DESCRIPTION

The present disclosure provides an improved shell structure for a luggage article. In particular, the present disclosure provides a shell structure that can absorb and disperse shock induced energy during a large impact such that the shell absorbs the impact and is resistant to permanent deformation. Disclosed herein is a hardside luggage shell having surface features extending at least partially over corner regions of the shell, the surface features having a depth deepest at the corner regions and decreasing as the surface features extend across the main face and/or sides to provide enhanced corner strength as described below and in the accompanying claims. In some embodiments, the surface features extend along the outer surface to form a loop from one corner region to an adjacent corner region.

In general, the shell includes surface features, such as grooves, formed in a pattern to provide increased strength and shock dispersion. In some examples, the number of surface features per linear unit of measure (density) may be greater in and around one or more corner regions of the luggage article. The surface features may also be formed in a lower density when positioned a distance away from the corner regions, such as in the central area of a major face of the luggage article, in order to mitigate or lessen the impact force as the force transmits through the luggage shell. The depth and width of the surface features may be respectively deeper and/or narrower in and around the corner regions and shallower and/or wider at a distance away from the corner regions.

Figure 1:
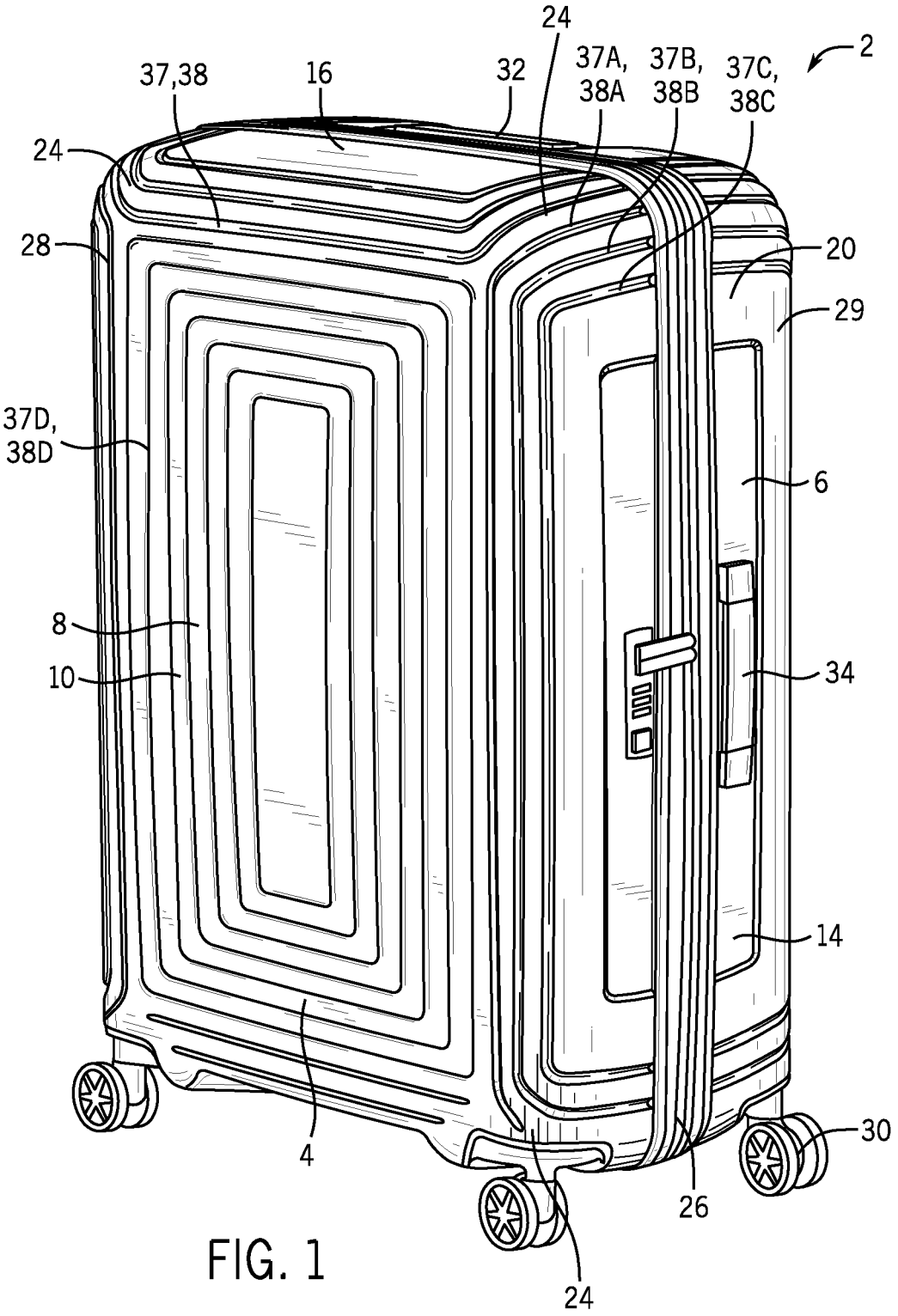
FIG. 1 is an isometric view a luggage case in accordance with some examples of the present disclosure.
Figure 2:
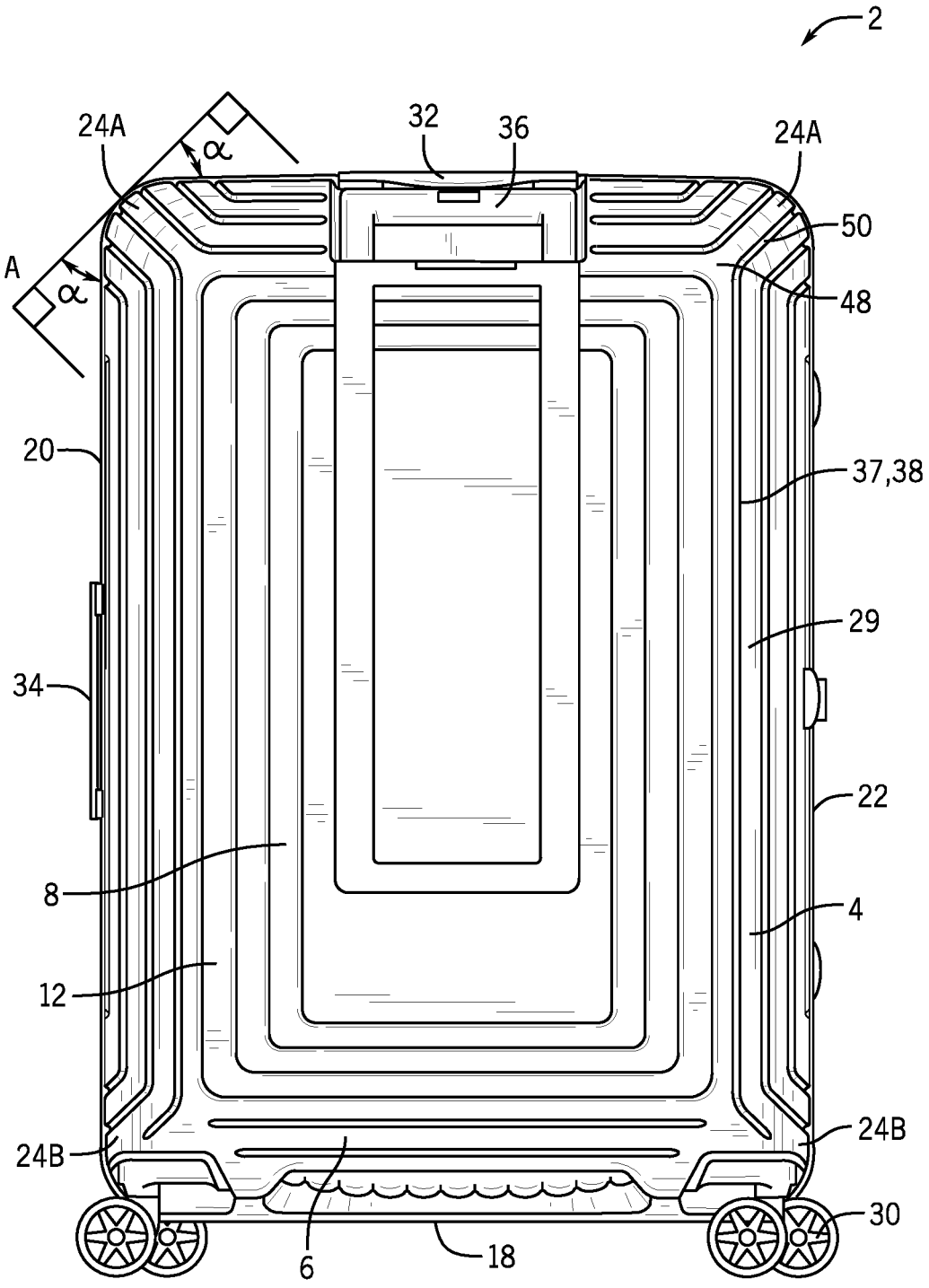
FIG. 2 is a rear elevation view of the luggage case of FIG. 1.
Figure 3:
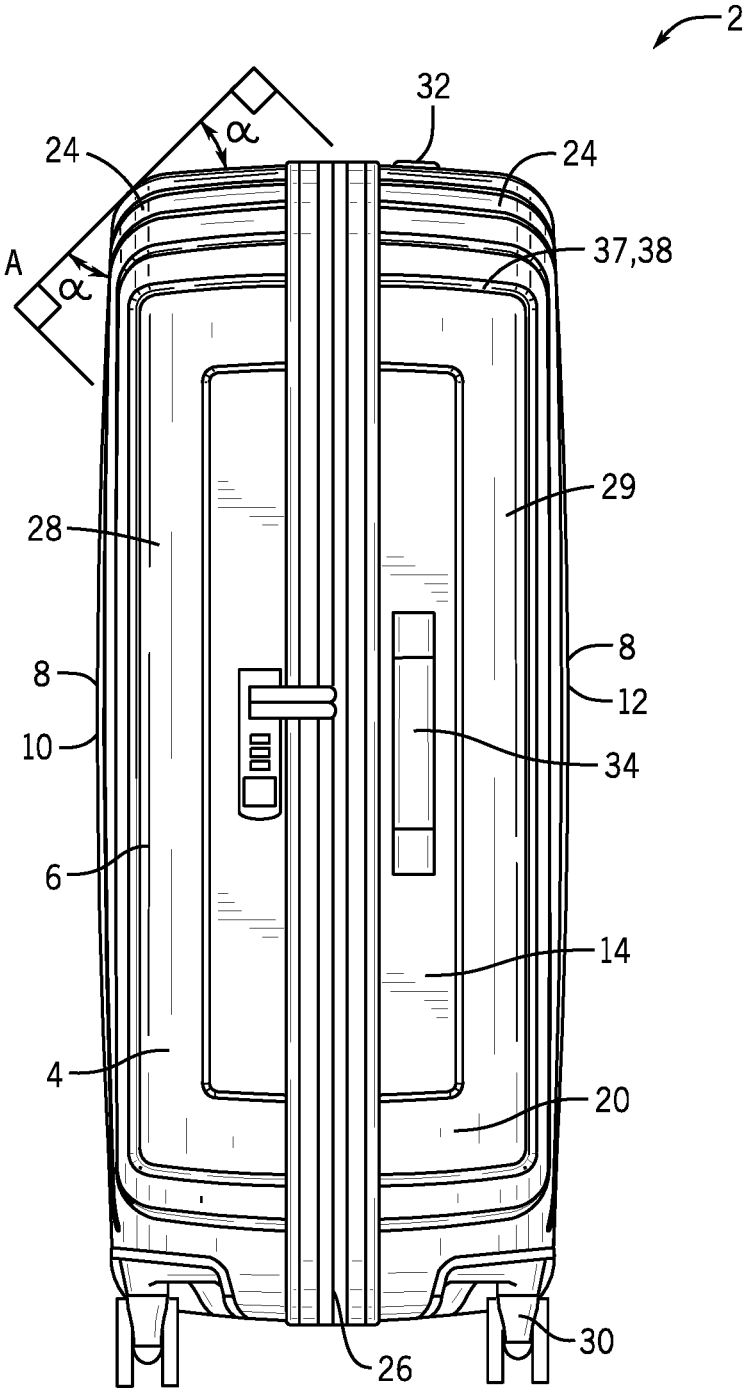
FIG. 3 is a right elevation view of the luggage case of FIG. 1.

Referring to FIGS. 1-3, a hard sided luggage case 2 is defined by a shell 4 formed by an outer layer 6 having two major faces 8 (front side 10 and rear side 12) separated by a peripheral wall 14. The peripheral wall 14 is formed of a top side 16, a bottom side 18, a right side 20, and a left side 22. Corner regions 24 are defined by the intersection of any two or three adjacent sides 10, 12, 16, 18, 20, 22. For example, the luggage case 2 includes four upper corner regions 24A and four lower corner regions 24B, each formed by the intersection of the three adjacent sides 10, 12, 16, 18, 20, 22. Additionally, edges formed by the intersection of any two adjacent sides 10, 12, 16, 18, 20, 22 may also be considered a "corner region." The luggage case 2 is formed from two shell portions (e.g., a first shell portion 28 and a second shell portion 29) hinged together on a split line 26 that extends along the central portion of the peripheral wall 14. As shown in FIGS. 1-3, in some examples, the split line 26 may extend substantially parallel to a major face 8. In other embodiments, however, the split line 26 may extend diagonally across at least a portion of the peripheral wall 14 and at an angle relative to a major face 8. A hinge (not shown) for pivotally connecting the two shell portions 28 and 29 together is positioned along the split line 26. A closure mechanism, such as a zipper, may extend along the split line 26. The zipper can be unzipped to allow the two shell portions 28 and 29 to pivot about the hinge to allow access to the interior. Various types of closure mechanisms and hinge structures are acceptable.

The luggage case 2 also preferably includes four spinner type wheels 30 as shown, or may include other wheel or support structures, to allow the user to pull or tow the luggage case 2 at an angle, or to guide it along in an upright position. The luggage case 2 may include a top carry handle 32 on the top side 16 and a side carry handle 34 on the left side 22, the right side 20, or both. The luggage case 2 may also include an extendable pull handle 36. The pull handle 36 may be aligned along the outside of the rear side 12 of the luggage case 2. Alternatively, the pull handle 36 may also be aligned along the rear side 12 but positioned inside the luggage case 2. While described herein with reference to a hard sided luggage case 2 having spinner wheels 30, the improvements described herein may also be advantageously implemented on other types of luggage, including non-wheeled and two-wheeled upright cases with or without handles.

With continued reference to FIGS. 1-3, each of the two shell portions 28 and 29 of the luggage case 2 may include surface features 37, such as grooves 38, formed by the outer layer 6 of the luggage case shell 4. The surface features 37 increase the strength and resilience of the luggage shell 4 by providing improved impact resistance when the luggage case 2 is impacted. Generally, impact forces are most harmful on the corner regions 24. Corner regions 24 are subject to impact forces, for instance, when the luggage case 2 is dropped on a corner region 24. Each corner region may at least partially define an apex region wherein an impact force may induce the greatest shock energy into the luggage case 2. The shock energy may propagate through the outer layer 6 and deform the shell 4. The surface features 37 may attenuate large impacts by concertinaing sufficiently to prevent permanent deformation of the corner regions 24. The corner region may also be defined by an edge, or part of an edge, formed between two of the various sides 10, 12, 16, 18, 20, 22.

The surface features 37 described herein may be formed in a laminate of one or more layers, and may include, for example, an inner layer and an outer layer, or an inner layer, an outer layer, and an intermediate layer. The layer(s) may be moldable hard side material, or a combination of hard side material and soft side material. The hard side material may be a thermoplastic material (self-reinforced or fiber-reinforced), ABS, polycarbonate, polypropylene, polystyrene, PVC, polyamide, or PTFE, among others. The luggage case 2 may be formed or molded in any suitable manner, such as by plug molding, blow molding, injection molding, or the like. Additionally, the thickness of the layer(s) in which the surface features 37 are formed may be as low as approximately 0.8 mm or less, and up to approximately 3 mm or more, and preferably may be in the range of 1 to 2.5 mm, and even more preferably in the range of 1 to 2 mm. The thickness of the layer(s) in which the surface features 37 are formed may be consistent, or may vary, across a section of the surface feature 37. Varying the thickness may affect the ability of the surface feature 37 to absorb an impact force, thereby allowing the dimensions of the surface feature 37 to be designed particularly for expected impact forces for the size of the luggage article 2 and its intended use. For instance, the thickness of the lamina at the bottom of the surface feature 37 may be greater than the thickness of the section(s) of lamina extending there between. Alternatively, the lamina at the bottom of the surface feature 37 may be thinner than the lamina section(s) extending there between. While the improvements described herein apply broadly to various types of surface features 37, in the examples described hereafter, the surface feature 37 is described a groove 38 for ease of the reader.

As an example of the grooves 38, FIGS. 1-3 disclose a plurality of grooves 38 forming a substantially nested quadrilateral patterned outer layer 6. The substantially nested quadrilateral pattern of the grooves 38 may be configured to substantially strengthen the structure of the shell 4, and to absorb energy from an impact force by dispersing through resilient deformation between the grooves 38. In this way, the shock energy is dissipated through at least the portion of the shell 4 where the grooves 38 are formed. The grooves 38 are configured to reduce the likelihood of permanent deformation of the corner regions 24 by increasing both the strength and absorption properties of the corner regions 24.

As shown in FIGS. 1-3, the grooves 38 may extend and/or loop from the split line 26, over a side 10, 12, 16, 18, 20, 22 of the luggage case 2, and back to the split line 26. For instance, in one embodiment, the grooves 38 may extend from a portion of the split line 26 adjacent one corner region 24 (e.g., a first corner region 24), over a portion of a major face 8 (e.g., the front side 10), and back to the split line 26 spaced away from the first corner region 24. In some embodiments, the grooves 38 may loop from one corner region 24 to an adjacent corner region 24. In some examples, the grooves 38 may loop from inside one corner region 24 to inside an adjacent corner region 24. In doing this, the grooves 38 extend at least partially across at least one of the sides 10, 12, 16, 18, 20, 22 and extend between and connect two adjacent corner regions 24 to increase the strength of the corner regions 24 and disperse the impact force away from the corner regions 24. For example, the grooves 38 may connect two upper corner regions 24A, two lower corner regions 24B, and/or an upper corner region 24A with a lower corner region 24B on the same side. The grooves 38 are positioned adjacent the corner regions 24, extend at least partially across at least one of the various sides 10, 12, 16, 18, 20, 22, and are spaced away from one another in a substantially parallel manner. Each groove 38 may generally extend along a similar curve as its adjacent groove 38. For example, as shown at least in FIG. 1, a plurality of grooves 38 may extend parallel to each other in connecting two adjacent corner regions 24. In other examples, however, the curvature of each individual groove 38 may be different from its adjacent groove 38 (on either side). In other embodiments, additional grooves 38 may extend for their lengths L across one of the sides 10, 12, 16, 18, 20, 22. In some examples, the additional grooves 38 may be a closed loop formed on one side of the luggage case 2 (e.g., the front side 10). For example, as shown in FIGS. 1-3, grooves 38 may loop around on themselves in substantially a quadrilateral shape on a major face 8 (front or rear sides 10, 12) of the luggage case 2. A plurality of successively stepped grooves 38 may be formed by the outer layer 6 on the major face 8 to form a substantially nested quadrilateral pattern. In such embodiments, the successively stepped looped grooves 38 provide flexibility in a direction normal to the major face 8. With reference to FIG. 2, the grooves 38 are considered to be closed loop despite intervening structure (e.g., the pull handle 36) interrupting the groove 38.

Figure 4:
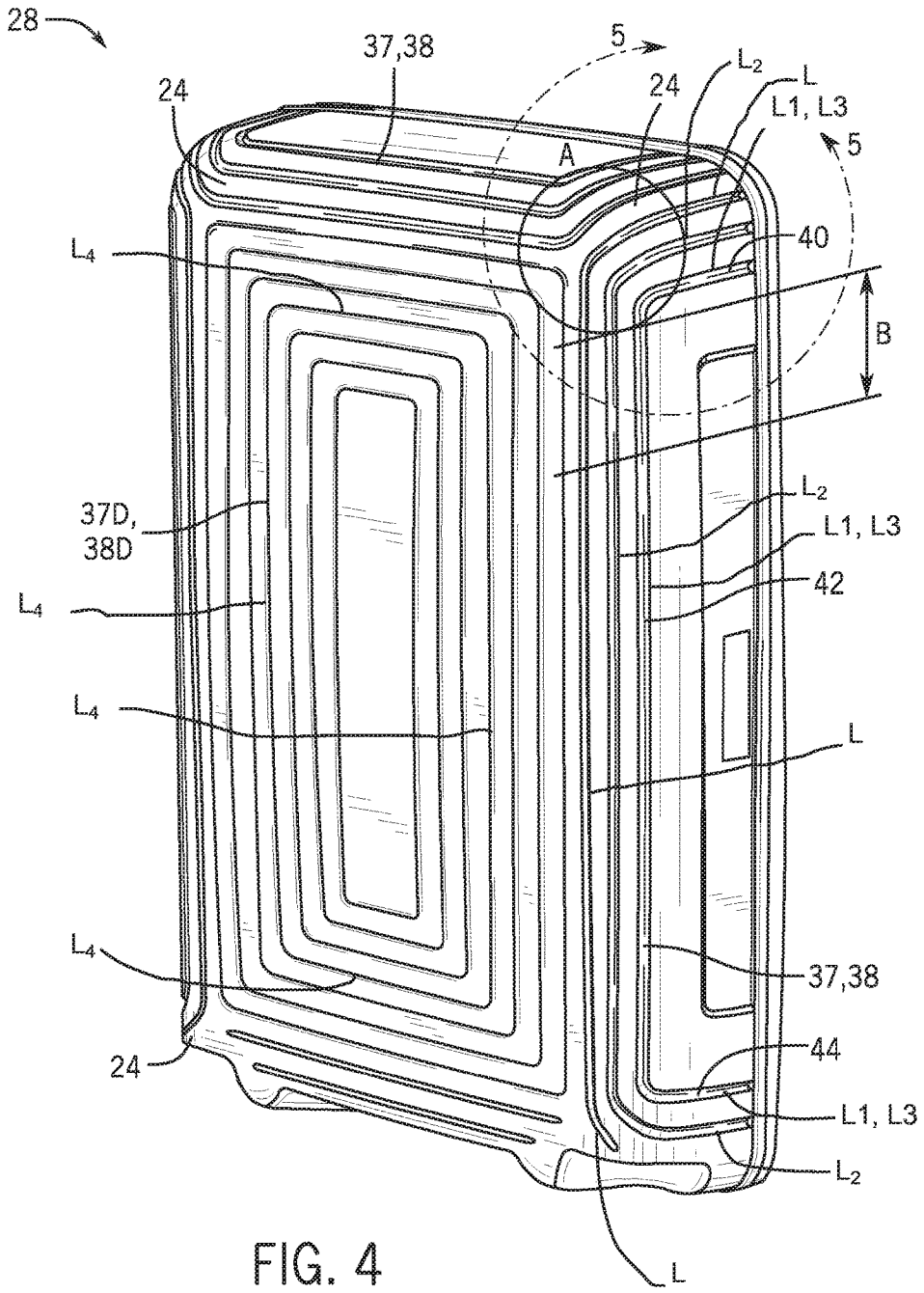
FIG. 4 is an isometric view of a luggage shell in accordance with some examples of the present disclosure.

With reference to FIGS. 2, 3, and 4, an individual groove 38 may include a first portion 40, a second portion 42, and a third portion 44. The first portion 40 may by positioned on the peripheral wall 14 adjacent a first corner region 24 and extend at an angle relative to the second portion 42. The third portion 44 may by positioned on the peripheral wall 14 adjacent a second corner region 24 and extends at an angle relative to the second portion 42. The second portion 42 may extend between the first portion 40 and the third portion 44, and in some embodiments may extend substantially parallel or at an angle relative to a major face 8 and/or the split line 26. In some embodiments, at least a portion of the second portion 42 may extend over a major face 8 (e.g., the front side 10) of the luggage case 2. As shown in FIGS. 2, 3, and 4, in some examples, the first and third portions 40, 44 may extend at substantially right angles relative to the second portion 42. In embodiments where the split line 26 is parallel to a major face 8, the first and third portions 40, 44 may extend at substantially right angles relative to the split line 26, and the second portion 42 may extend substantially parallel to the split line 26.

Figure 5:
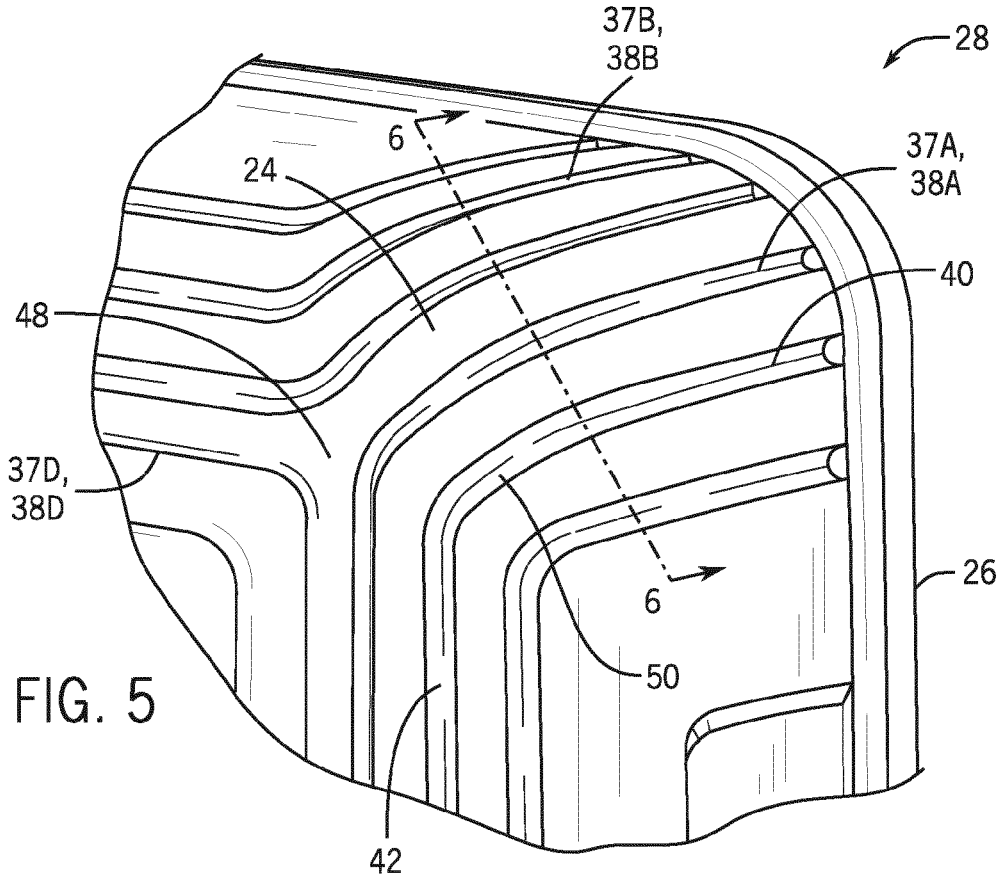
FIG. 5 is an enlarged fragmentary view of Detail 5 of FIG. 4.
Figure 6:
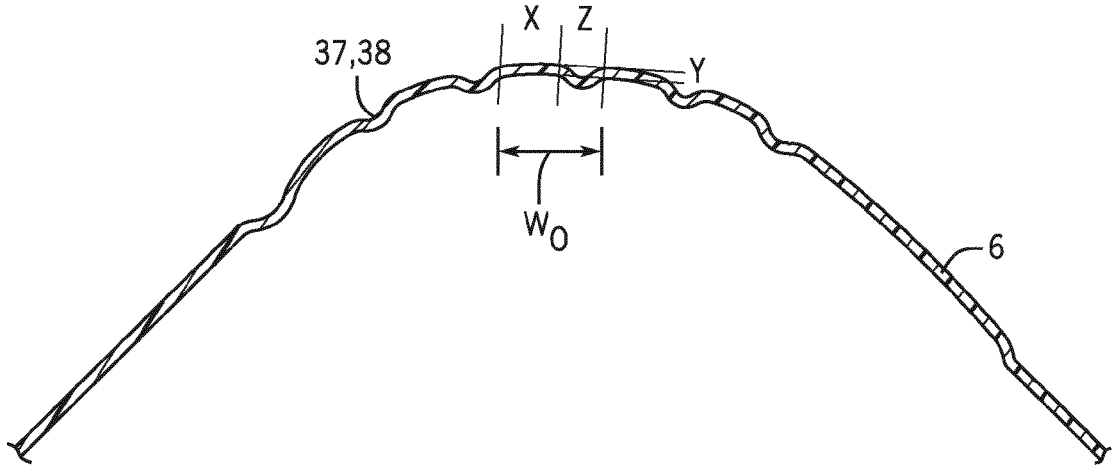
FIG. 6 is a representative fragmentary cross-sectional view of the grooves formed by the outer layer of a luggage case taken along line 6-6 of FIG. 5.

With reference to FIGS. 1-6, an individual groove 38 may extend inward a depth Y from a nominal surface 48 of the outer layer 6. With reference to FIG. 6, each individual groove 38 also defines a width dimension Z and a length (or extension) dimension L. The depth Y is measured in a direction extending into the luggage case 2 from the nominal surface 48 to the bottom of the groove 38. The width dimension Z is measured from the top of the groove 38 on one side to the top of the groove 38 on the other side. The length dimension L is measured along the generally longitudinal direction along which the groove 38 extends. In some examples, the width and depth Z, Y of a groove 38 may vary along its length L, and may be the same as, or different from, adjacent grooves 38. As explained below, the grooves 38 may be positioned in a manner to have a higher density in and around one or more corner regions 24 of the luggage article, and also may be formed to occur in a lower density with distance away from the corner regions 24. Density in this instance includes the number of grooves per linear unit of measure. The transitions between the grooves 38 and the nominal surface 48 may be angular as shown in FIG. 6, which aids in the resilience and flexibility of the grooves 38 in response to an impact force. In some examples, however, the transitions between the grooves 38 and the nominal surface 48 may be smooth, which may generally increase the stiffness of the grooves 38 in response to an impact force.

The description below associated with FIG. 6 details the measurement of the depth Y and the width Z, and relative changes thereto, for the groove 38. The proportion of the width Z of the grooves 38 may change along the length L; while an overall width $W_O$ (made up of the width Z of the groove 38 and a distance X between adjacent grooves 38) of the grooves 38 may stay relatively consistent along the length L. For example, the width Z may increase and the distance X may proportionally decrease to maintain the overall width $W_O$ relatively consistent along the length L. Contrastingly, the overall width $W_O$ of the grooves 38 may vary along the length L of the grooves 38, and may be the same as, or different from, the adjacent grooves 38. Generally, for a given material thickness, the deeper the depth Y and the smaller the width Z of a groove 38 (i.e., allowing a higher density of grooves), the more resilient the groove 38 is for absorbing and dissipating the impact force and the stronger the corner region 24 is for preventing deformation. Contrastingly, all else equal, the smaller the depth Y and the larger the width dimension Z (i.e., the smaller the density of the groove 38), the less absorptive and resilient the groove 38 and the weaker the corner region 24. A change in each of the depth or width dimensions Y, Z alone without the other, relative to the distance from the corner region 24, may be implemented. Each by itself has an effect on absorptive and resilient properties, and may be implemented separately from the other. In some embodiments, the number of grooves 38 may be kept constant among shell portions 28, 29 of various sizes. In such embodiments, the width Z of the grooves 38 may change to accommodate differently sized shell portions 28, 29.

With reference to FIGS. 4, 5, and 6, the depth and width dimensions Y, Z of the grooves 38 may vary along the length L of the grooves 38 to dissipate shock energy throughout the shell portions 28, 29 and prevent permanent deformation. As noted above and more fully explained below, the grooves 38 positioned adjacent the corner regions 24 may have a narrower width dimension Z and a deeper depth Y, and thus are more densely positioned. As the distance from the corner regions 24 increases, the depth Y of the groove 38 may generally decrease, and/or the width dimension Z of the groove 38 may generally increase. Similarly, the distance X between adjacent grooves 38 may be smaller near the corner regions 24 and greater with distance away from the corner regions 24. These dimensional changes result in a visual effect of the grooves 38 dissipating as they extend away from the corner regions 24. More densely-spaced grooves 38 provide a generally greater resilience to impact forces near the corner regions 24 where needed, and create less likelihood of permanent deformation. The grooves 38 may be less densely packed at locations spaced away from the corner regions 24 because the impact force has been dissipated or attenuated by the time it reaches these more remote regions and less resilience is needed and/or greater flexibility is desired. For example, the grooves 38 may gradually disappear entirely within the interior field of the sides 10, 12, 16, 18, 20, 22 with distance away from the corner regions 24. In some embodiments, the depth Y of the grooves 38 within the interior field of the sides 10, 12, 16, 18, 20, 22 may be between about 0 percent and about 50 percent, preferably between about 20 percent and about 30 percent and more preferably about 25 percent, compared to the depth Y of the grooves 38 adjacent the corner regions 24. In some embodiments, the depth Y of the grooves 38 within the interior field of the sides 10, 12, 16, 18, 20, 22 is held constant, for example, at about 0.5 mm. In some embodiments, the sides 10, 12, 16, 18, 20, 22 may be relatively flexible compared to the stiffer corner regions 24, which allows the luggage case 2 to pass a corner drop test without using supplemental shell reinforcement. Though the depth Y of the grooves 38 within the interior field of the sides 10, 12, 16, 18, 20, 22 may be about 0 percent for maximum relative corner strength, some depth Y may be necessary for the overall stability of the luggage case 2.

With continued reference to FIGS. 4, 5, and 6, the depth Y of the grooves 38 may depend on any one or more of the following: the depth of the shell portion 28 or 29, the thickness of the shell portion 28 or 29, the distance X between adjacent grooves 38, the number of grooves 38, anticipated loading of the luggage case 2, the dimensions of the luggage case 2 (e.g., height, width, etc.), and the width Z of the grooves 38, among other factors. For example, the deeper and thicker the shell portion 28 or 29, the greater the depth Y of the grooves 38. Additionally or alternatively, the larger the luggage case 2 in either its width or height dimension, the greater the depth Y of the grooves 38. Similarly, the greater the width Z of the grooves 38 and/or anticipated loading of the luggage case 2, the greater the depth Y of the grooves 38. In some embodiments, the less number of grooves 38, the greater the depth Y, all else being equal. In one embodiment, the depth Y of the grooves 38 is approximately equal to the material thickness of the shell portion 28 or 29. Additionally or alternatively, the depth Y of the grooves 38 may be greater than the material thickness of the shell portion 28 or 29. In some embodiments, the depth Y may vary between about 20 percent and about 67 percent of the width Z of the grooves 38 (e.g., about 37.5 percent) depending on the particular application. Thus, with reference to FIG. 6, for a shell portion 28 or 29 having a depth of 280 mm and a distance X between two adjacent grooves 38 of 14 mm, the depth Y of a groove 38 may vary between 2 mm and 4 mm, and the width Z of the groove 38 may vary between 6 mm and 10 mm. Ideally, for a shell portion 28 or 29 having a depth of 280 mm and a distance X between two adjacent grooves 38 of 14 mm, the depth Y of the grooves 38 is 3 mm, and the width Z of the grooves 38 is 8 mm. These values may be proportionally scaled with any one or more of the following: the depth of the shell portion 28 or 29, the dimensions of the luggage case 2, the sheet thickness, the number of grooves 38, anticipated loading, as well as with the distance X between adjacent grooves 38. Table 1 below illustrates non-limiting examples of these values scaled with the depth of the shell portion 28 or 29. For each shell portion depth, the corresponding case size (i.e., height), sheet thickness, and anticipated loading are also provided in Table 1 below. The numbers are approximate and small variations (i.e., ±10 percent) are contemplated.

TABLE 1

Examples of Groove Width and Depth Dimensions

| | Depth of Shell Portion 28 or 29 (mm) | Case Size (cm) | Sheet Thickness (mm) | Test Load (kg) | Preferable Width Z (mm) | More preferable Width Z (mm) | Preferable Depth Y (mm) | More preferable Depth Y (mm) |
|---|---|---|---|---|---|---|---|---|
| 1 | 200 | 55 | 1.7 | 10 | 4.1-6.8 | 5.4 | 1.4-2.7 | 2.0 |
| 2 | 265 | 69 | 1.9 | 20 | 5.7-9.5 | 7.6 | 1.9-3.8 | 2.8 |
| 3 | 280 | 75 | 2.0 | 22 | 6-10 | 8 | 2-4 | 3 |
| 4 | 295 | 81 | 2.1 | 25 | 6.3-10.5 | 8.4 | 2.1-4.2 | 3.2 |

Figure 7:
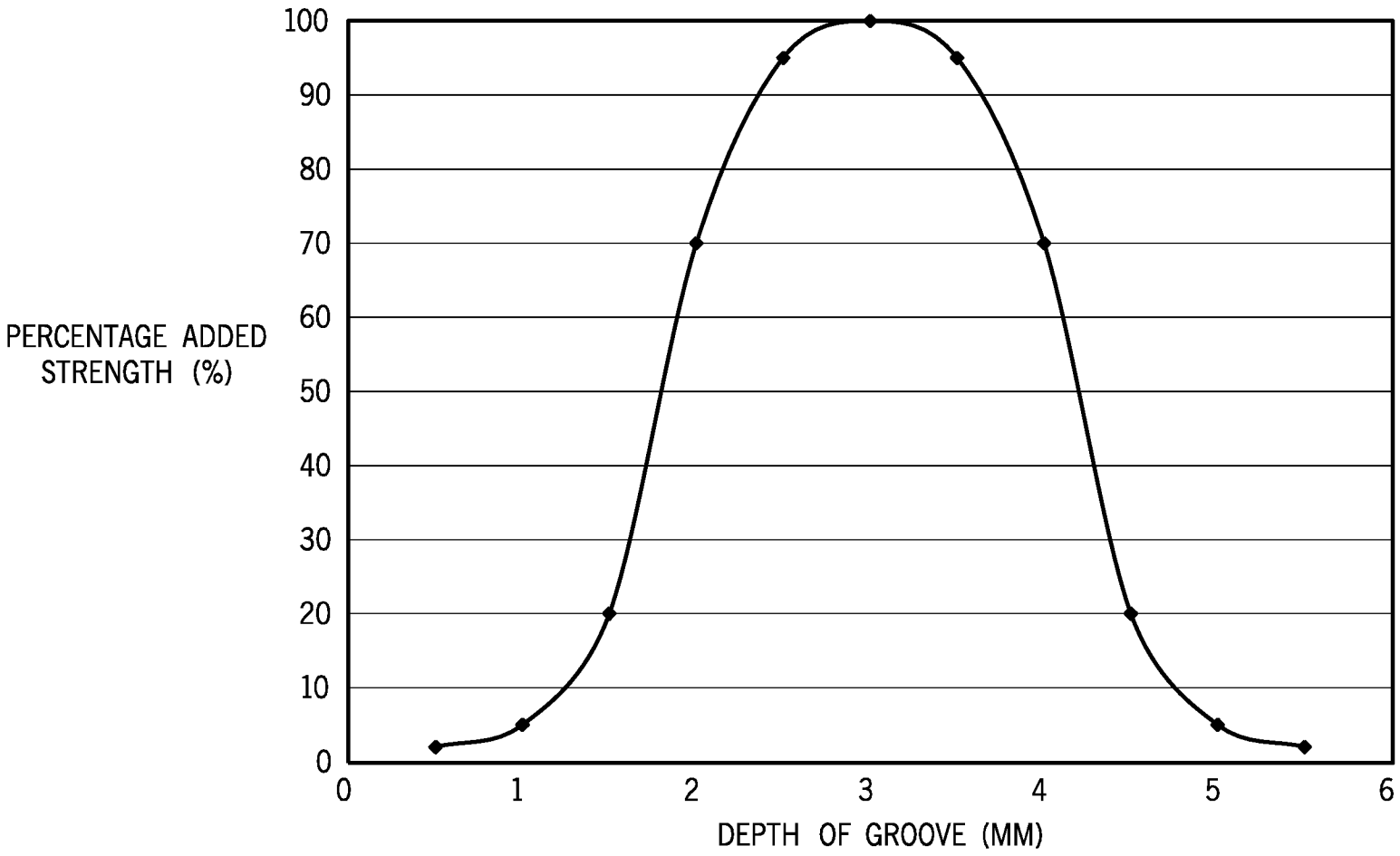
FIG. 7 is a graphical representation of the relative increase in strength (in percentage) provided by increasing the depth of the grooves.

To ensure the shell portions 28, 29 have adequate strength and/or resilient properties, the maximum value for the depth Y of the grooves 38 may be limited to about 50 percent of the width dimension Z. Deeper grooves may locally compromise the wall thickness of the shell portions 28, 29, thereby making the shell portions 28, 29 in that area insufficiently strong and/or insufficiently resilient. For example, with reference to FIG. 7, the additional strength (in percentage) provided to the shell portions 28, 29 (e.g., to the corner regions 24) by the grooves 38 relative to the depth Y of the grooves 38 may generally fall on a bell curve (note the width Z of the grooves 38 is held constant). As illustrated in FIG. 7, increasing the depth Y of the grooves 38 increases the strength of the corner regions 24 until the depth Y is about 50 percent of the width dimension Z of the groove 38. As can be seen in FIG. 7, when the depth Y is increased to greater than about 50 percent of the width dimension Z the strength (in percentage) of the shell portions 28, 29 is decreased. Thus, as a deeper groove is formed beyond the preferable depth:width ratio, the wall thickness of the shell becomes locally too thin and the shell, in that area, becomes weaker, rather than stronger.

With reference to FIGS. 2, 3, and 4, when the depth Y of the grooves 38 start decreasing along the length L of the grooves 38 within the interior field of the luggage case 2 may depend on the depth of the shell portion 28 or 29. In some examples, the grooves 38 may be deeper within a circular area A having a diameter and centered substantially at the apex region and encompassing at least a portion of the corner regions 24. In some examples, the depths Y of the grooves 38 may transition from deeper to shallower within the circular area A. In some examples, the depths Y of the grooves may transition from deeper to shallower with distance away from the center of the circular area A to the edge of the circular area A. For example, for a shell portion 28 or 29 having a depth of 280 mm, the depths Y of the grooves may transition from 4 mm at the center of the circular area A to 2 mm at the edge of the circular area A. As best seen in FIGS. 2 and 3, the circular area A may generally define a plane that extends generally tangentially from the corner regions 24 at an angle $\alpha$ relative to the sides 10, 12, 16, 18, 20, 22 of the luggage case 2. For example, the plane defined by the circular area A extends at a 45 degree angle relative to the front, top, and right sides 10, 16, 20. The depths of the grooves 38 may decrease with distance B away from the circular area A. For example, for a shell portion 28 having a depth of 280 mm, the diameter of the circular area A encompassing deep grooves 38 may be in a range of 80 mm to 150 mm, with an optimal diameter of 110 mm. Outside the circular area A, the depths of the grooves 38 may decrease over a distance B in a range of 20 mm to 80 mm, with an optimal distance B of 40 mm. In some embodiments, the depths of the grooves 38 may fade out completely with distance B away from the circular area A.

With reference to FIGS. 1, 4, and 5, the grooves 38 may loop from one corner region 24 to an adjacent corner region 24 to both strengthen and disperse shock energy throughout the shell 4 and further prevent permanent deformation of the corner regions 24. As shown in FIGS. 1, 4, and 5, for example, a first groove 38A extends for at least a first portion 40 of its length $L_1$ substantially perpendicular to the split line 26 and adjacent to a first corner region 24. The first groove 38A also extends for at least a second portion 42 of its length $L_1$ substantially parallel to the split line 26 at least partially across at least one of the sides 10, 12, 16, 18, 20, 22 at a first distance spaced away from the split line 26. The first groove 38A also extends for at least a third portion 44 of its length $L_1$ substantially perpendicular to the split line 26 and adjacent to a second corner region 24 adjacent the first corner region 24. As such, the first groove 38A extends from a first corner region 24 to an adjacent second corner region 24 in a substantially looped manner. Similar to the first groove 38A, a second groove 38B extends for at least a first portion 40 of its length $L_2$ substantially perpendicular to the split line 26 and adjacent to the first corner region 24. The second groove 38B also extends for at least a second portion 42 of its length $L_2$ substantially parallel to the split line 26 at least partially across at least one of the sides 10, 12, 16, 18, 20, 22 at a second distance spaced away from the split line 26. The second groove 38B also extends for at least a third portion 44 of its length $L_2$ substantially perpendicular to the split line 26 and adjacent to the second corner region 24. In this manner, the first and second grooves 38A, 38B may begin and terminate adjacent to, and may interconnect, respective adjacent corner regions 24. The grooves 38 may also form a partial loop by extending from one corner region 24 for at least a first portion of its length L substantially perpendicular to the split line 26 and adjacent to the first corner region 24 and also extends for at least a second portion of its length L substantially parallel to the split line 26. However, the groove does not make a complete loop to an adjacent corner region 24. In some embodiments, a third groove 38C may be configured similarly to the first and second grooves 38A, 38B. In other embodiments, a fourth groove 38D may by formed by the outer layer 6 having a fourth length $L_4$. Unlike the first, second, and third grooves 38A, 38B, 38C, the fourth groove 38D may extend for its length $L_4$ across only one of the sides 10, 12, 16, 18, 20, 22. In some examples, the fourth groove 38D may be a closed loop positioned on a major face 8 (defined as either the front or rear side 10, 12) of the shell 4 and may be configured substantially in a quadrilateral shape. As explained above, a plurality of subsequently stepped grooves 38D may be formed on the major faces 8 to provide flexibility and resilient deformation of the major faces 8. The first, second, third, and fourth grooves 38A, 38B, 38C, 38D may or may not be adjacent one another. Also, the first, second, and third grooves 38A, 38B, 38C may extend for their respective lengths $L_1$, $L_2$, $L_3$ across one of the sides 10, 12, 16, 18, 20, 22.

With continued reference to FIGS. 1, 4, and 5, in some examples, the first groove 38A has a deeper depth Y and a smaller width dimension Z than the second groove 38B, and the second groove 38B has a deeper depth Y and a smaller width dimension Z than the third groove 38C, and so on. Additionally, the first distance from the split line 26 may be greater than the second distance from the split line 26, and the third distance from the split line 26 may be less than both the second distance and the first distance. In some examples, each of the second portions 42 of the respective grooves 38 may run parallel to the edges formed between two of the various sides 10, 12, 16, 18, 20, 22.

Referring now to FIGS. 1-4, the shell portions 28, 29 may contain at least one groove 38 interconnecting two adjacent corner regions 24 to provide sufficient corner strength and prevent permanent deformation of the corner regions 24. However, the shell portions 28, 29 may include any number of grooves 38 limited only by the size and dimensions of the particular luggage case 2. For example, as shown in FIGS. 1-4, the shell portions 28, 29 may include three grooves 38 interconnecting adjacent corner regions 24, seven closed-loop grooves 38 disposed on the front side 10 of the shell portion 28, and four closed-loop grooves 38 disposed on the rear side 12 of the shell portion 29. In all, six grooves 38 may be adjacent each corner region 24, with three of the six grooves 38 extending towards an adjacent corner region 24 and the other three grooves 38 extending towards another adjacent corner region 24. Individual grooves 38 may extend differently relative to adjacent grooves 38 with respect to a corner region 24. For example, some grooves 38 may extend from an upper corner region 24A to an adjacent lower corner region 24B, while other grooves 38 may extend from the same upper corner region 24A to an adjacent upper corner region 24A or an adjacent lower corner region 24B. The extension of the grooves 38 relative to the corner region 24 affects the absorptive and resilience characteristics of the grooves 38. It should be noted that while the above was described relative to the front and rear sides 10, 12, it is contemplated that the same or similar groove layout may be implemented on any of the sides 10, 12, 16, 18, 20, 22 of the luggage case 2. For example, grooves 38 may extend on each side 10, 12, 16, 18, 20, 22 of the luggage case 2. In such embodiments, each corner region 24 may be connected to an adjacent corner region 24 via a groove 38. In other embodiments, grooves 38 may extend across only the top, left, and right sides 16, 22, 20 of the luggage case 2.

Referring now to FIGS. 1-3, as mentioned above, the first groove 38A may have a first length $L_1$, the second groove 38B may have a second length $L_2$, and so on. In some examples, the first length $L_1$ may be greater than the second length $L_2$. The respective lengths $L_1$, $L_2$ of the grooves 38A, 38B may each define a coextensive 3-D curve. As such, intermediate segments 50 may transition the first, second, and third portions 40, 42, 44 of an individual groove 38 together. For example, intermediate segments 50 may transition the first portion 40 to the second portion 42 and the second portion 42 to the third portion 44. In some examples, the intermediate segments 50 may extend for at least portions of their lengths at an angle relative to the corner regions 24 and at an angle relative to the second portions 42. For example, as best seen in FIG. 2, the intermediate segments 50 may extend at 45 degree angles relative to the corner regions 24 and 135 degree angles relative to the second portions 42 when viewed from the front side 10 or the rear side 12. For example, as shown in FIG. 2, the top side 16 and the right side 20 may define a substantially right angle at an upper corner region 24A. The intermediate segments 50 may bisect the right angle defined by the top side 16 and the right side 20, thereby extending for at least a portion of their lengths at substantially 45 degree angles relative to the top side 16 and the right side 20. In such embodiments, the intermediate segments 50 and the second portions 42 of two grooves 38 looping from a common corner region 24 to diagonally opposite corner regions 24 on the same side, together with a closed-looped third groove 38C positioned on a major face 8 may define a substantially Y-shaped nominal surface 48 adjacent the common corner region 24.

With reference to FIGS. 4-6, each of the grooves 38 may extend a depth Y inward from the nominal surface 48 of the shell 4. In some examples, the depth Y of the first groove 38A may be deeper than the depth Y of the second groove 38B. Likewise, the depth Y of the second groove 38B may be deeper than the depth Y of the third groove 38C. Such configurations have the advantage of better absorbing shock energy induced on the luggage case 2 substantially near the corner regions 24 by an impact force than previous designs.

As explained above, the width Z of the grooves 38 may vary to disperse impact force energy throughout portions of the luggage case 2. Referring to FIGS. 5 and 6, the first groove 38A may have a first width $Z_1$, the second groove 38B may have a second width $Z_2$, and the third groove 38C, if included, may have a third width $Z_3$, and so on. The third width $Z_3$ may be greater than the second width $Z_2$, and the second width $Z_2$ may be greater than the first width $Z_1$. As explained above, in some examples, the respective widths $Z_1$, $Z_2$, $Z_3$ of the first, second, and third grooves 38A, 38B, 38C may increase as the distance from the corner regions 24 increases. For example, the widths Z of the grooves 38 may be relatively narrower near the corner regions 24 and relatively wide with distance away from the corner regions 24. In some examples, the widths Z of the grooves 38 may alternate from narrower to wider.

The angle of incidence of the impact force on the corner region 24 may vary widely. It will almost always result in compressive forces being applied in component vectors in the plane of the sides 10, 12, 16, 18, 20, 22 of the luggage case 2. The impact force will also result in bending loads due to component force vectors out of the plane of the luggage case sides 10, 12, 16, 18, 20, 22. The grooves 38 described herein improve corner region impact performance by enhancing the absorption of both the compressive and bending forces. For example, the deep grooves 38 near the corner regions 24 may concertina in a direction substantially perpendicular to the grooves 38 with the grooves 38 closing up together under impact. That is, the grooves 38 may resiliently deform (e.g., concertina) under load to absorb impact energy by allowing the grooves 38 to at least partially close under impact. This "concertina effect" of the grooves 38 permits the shell 4 to deflect as a whole but not permanently deform. As the force propagates through the shell portion 28 or 29, the shallower grooves 38 positioned away from the corner regions 24 may also flex, thereby further absorbing impact energy within the interior field of the luggage case 2. The grooves 38 also provide improved strength of the shell 4 by increasing the shell's resistance to bending forces.

Referring now to FIG. 1-4, as discussed above, where the split line 26 is substantially parallel to a major face 8, an individual groove 38 may extend at least partially at substantially right angles relative to the split line 26 in first and third portions 40, 44 adjacent the first and second corner regions 24, respectively, and at least partially in a substantially parallel relationship with the split line 26 in a second portion 42. Notwithstanding, the grooves 38 may deviate somewhat from the preferred orientation while still being sufficiently absorptive of the impact force. In some embodiments, the grooves 38 may extend at substantially any angle relative the split line 26 in their first and third portions 40, 44 adjacent the split line 26. For example, the first and third portions 40, 44 may generally extend from the split line 26 and towards each other. In other examples, the first and third portions 40, 44 may generally extend from the split line 26 and away from each other. In some examples, the first groove 38A may be oriented differently than the second groove 38B relative the split line 26. In other embodiments, the grooves 38 may curve relative to the split line 26 in their respective second portions 42. For example, the second portions 42 of the grooves 38 may curve concave toward, convex away, or in opposite directions relative to the split line 26. In some examples, the second portion 42 of the first groove 38A may curve differently than the second portion 42 of the second groove 38B relative to the split line 26. This permitted variation allows for designing curvature into the grooves 38 to facilitate a wider variety of impact force angles, as well as permitting flexibility in the resulting aesthetic appearance the grooves 38 have on the overall luggage case 2.

Referring to FIG. 4, in addition to being implemented on a hard-sided luggage case 2 having spinner wheels 30, the grooves 38 described herein may be advantageously implemented on other types of luggage. For example, the present disclosure may be implemented as a single shell portion 28 without wheels 30. The single shell portion 28 may also be implemented as part of non-wheeled or two-wheeled upright cases with or without handles, or other types of luggage. The single shell portion 28 may be oriented substantially vertical when implemented as part of one type of luggage, or the single shell portion 28 may be oriented substantially horizontal when implemented as part of a different type of luggage.

While described herein with reference to a groove 38, the groove 38 may be more generally referred to as a surface feature 37, which may also be a ridge, or a combination of a groove and a ridge. Thus, each individual surface feature 37, whether a groove, a ridge, or a combination of a groove and a ridge, may be configured as described above with reference to a groove 38.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as not limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A luggage article comprising:

a shell at least partially formed by an outer layer and including first and second shell portions formed at least partially by the outer layer and selectively secured together at a split line, the first shell portion defining a first corner region and a second corner region, each corner region defined by an intersection between a major face and at least one side wall; and at least one first surface feature and at least one second surface feature formed by the outer layer, wherein:

the at least one first surface feature and the at least one second surface feature are grooves, the at least one first surface feature and the at least one second surface feature are adjacent to each other and each surface feature extends from a portion of the split line proximate the first corner region, over a portion of the major face, and back to a different portion of the split line proximate the second corner region, and the at least one second surface feature is positioned within a boundary defined by the at least one first surface feature and the split line.

2. The luggage article of claim 1, wherein:

the at least one first surface feature has a length and includes first, second, and third portions;

the first portion extends at an angle relative to the second portion, and the third portion extends at an angle relative to the second portion;

the first portion is positioned on a peripheral wall adjacent the first corner region and extends away from the portion of the split line;

the third portion is positioned on the peripheral wall adjacent the second corner region and extends away from the portion of the split line; and the second portion extends between the first portion and the third portion.

3. The luggage article of claim 2, wherein the at least one second surface feature has a length and includes first, second, and third portions, wherein:

the first portion of the at least one second surface feature extends at an angle relative to the second portion of the at least one second surface feature, and the third portion of the at least one second surface feature extends at an angle relative to the second portion of the at least one second surface feature;

the first portion of the at least one second surface feature is positioned on the peripheral wall adjacent the first corner region and extends away from the portion of the split line;

the third portion of the at least one second surface feature is positioned on the peripheral wall adjacent the second corner region and extends away from the portion of the split line; and the second portion of the at least one second surface feature extends between the first portion and the third portion of the at least one second surface feature.

4. The luggage article of claim 2, wherein the first shell portion defines a third corner region adjacent the first corner region and diagonally opposite the second corner region, the luggage article further comprising at least one third surface feature formed by the outer layer, the at least one third surface feature having a length and including first, second, and third portions, wherein:

the first portion of the at least one third surface feature extends at an angle relative to the second portion of the at least one third surface feature, and the third portion of the at least one third surface feature extends at an angle relative to the second portion of the at least one third surface feature;

the first portion of the at least one third surface feature is positioned on the peripheral wall adjacent the first corner region and extends away from the portion of the split line, the third portion of the at least one third surface feature is positioned on the peripheral wall adjacent the third corner region and extends away from the portion of the split line, and the second portion of the at least one third surface feature extends between the first portion and the third portion of the at least one third surface feature.

5. The luggage article of claim 2, wherein:

the depth of the at least one first surface feature comprises a first depth at least partially within the first portion, a second depth at least partially within the second portion, and a third depth at least partially within the third portion.

6. The luggage article of claim 5, wherein the first depth and the third depth are greater than the second depth.

7. The luggage article of claim 2, wherein the first portion of the at least one first surface feature extends along the peripheral wall or the major face; and the second portion of the at least one first surface feature or the at least one second surface feature extends along the major face.

8. The luggage article of claim 3, wherein:

the first portion of the at least one first surface feature extends at substantially a right angle relative to the second portion of the at least one first surface feature; and the third portion of the at least one first surface feature extends at substantially a right angle relative to the second portion of the at least one first surface feature.

9. The luggage article of claim 1, wherein:

the at least one first surface feature has a depth the at least one second surface feature has a depth; and the depth of the at least one first surface feature or the at least one second surface feature positioned further from the nearer one of the corner regions is less than the depth of the other surface feature positioned closer to the nearer one of the corner regions.

10. The luggage article of claim 9, wherein:

the at least one first surface feature has a width; and the depth of the at least one first surface feature is between about 20 percent and about 67 percent, or about 38 percent, of the width of the at least one first surface feature.

11. The luggage article of claim 1, wherein:

the at least one first surface feature has a width;

the at least one second surface feature has a width; and the width of the at least one first surface feature or the at least one second surface feature positioned further from a nearer one of the corner regions is greater than the width of the other surface feature positioned closer to the nearer one of the corner regions.

12. The luggage article of claim 1, wherein at least portions of one of the at least one first surface feature and at least portions of one of the at least one second surface feature extend at substantially right angles relative to the split line.

13. The luggage article of claim 1, further comprising at least one third surface feature formed by the outer layer, wherein said at least one third surface feature is positioned on a side of the luggage article and forms a closed loop.

14. The luggage article of claim 13, wherein the at least one first surface feature, the at least one second surface feature, and the at least one third surface feature define a substantially Y-shaped nominal surface adjacent the first corner region.

15. The luggage article of claim 1, wherein a portion of one of the at least one first surface feature or a portion of one of the at least one second surface feature extends at substantially a 45 degree angle relative to the first corner region.

16. The luggage article of claim 1, wherein a portion of the at least one first surface feature and a portion of the at least one second surface feature extend substantially parallel to each other, or extend substantially parallel to an edge formed by the intersection of the major face and the at least one side wall of the luggage article.

17. The luggage article of claim 1, wherein:

the at least one first surface feature has a depth; and the depth of the at least one first surface feature is between about 0 percent and about 50 percent, or between about 20 percent and about 30 percent, or about 25 percent, of the width of the at least one first surface feature adjacent the first corner region.

18. The luggage article of claim 9, wherein:

the depth of the at least one first surface feature within the major face is less than the depth of the at least one first surface feature adjacent the first corner region; and the depth of the at least one first surface feature within the major face is about 0.5 mm.

19. The luggage article of claim 1, wherein:

the at least one first surface feature has a depth; and the depth of the at least one first surface feature adjacent the first corner region is between about 1 mm and about 4 mm, or between about 2 mm and about 3.2 mm.

20. The luggage article of claim 1, wherein:

the at least one first surface feature has a width; and the width of the at least one first surface feature is between about 4 mm and about 10 mm, or between about 5.5 mm and about 8.5 mm.

21. The luggage article of claim 1, wherein:

the at least one first surface feature has a depth;

the depth of the at least one first surface feature is greater nearer the first corner region; and the depth of the at least one first surface feature decreases with distance away from the first corner region.

22. A luggage article comprising:

a shell at least partially formed by an outer layer, and including first and second shell portions formed at least partially by the outer layer and selectively secured together at a split line, the first shell portion defining a first corner region and an adjacent second corner region; and at least one first groove and at least one second groove formed by the outer layer, the at least one first groove having a length and including first, second, and third portions, wherein:

the first portion extends at an angle relative to the second portion, and the third portion extends at an angle relative to the second portion;

the first portion is positioned on a peripheral wall adjacent the first corner region and extends away from a portion of the split line;

the third portion is positioned on the peripheral wall adjacent the second corner region and extends away from a portion of the split line;

the second portion extends between the first portion and the third portion; and the at least one second groove is positioned within a boundary defined by the first, second and third portions and the split line.

* * * * *